United States Patent [19]

Roda

[11] Patent Number: 4,638,574

[45] Date of Patent: Jan. 27, 1987

[54] REMOVABLE SHOE PROTECTOR

[75] Inventor: Dominick A. Roda, Meadville, Pa.

[73] Assignee: Roda Industries, Inc., Meadville, Pa.

[21] Appl. No.: 767,102

[22] Filed: Aug. 19, 1985

Related U.S. Application Data

[63] Continuation-in-part of Ser. No. 323,183, Nov. 20, 1981, abandoned.

[51] Int. Cl.[4] ..... A43B 3/20; A43B 13/22

[52] U.S. Cl. ..... 36/7.2; 36/72 R

[58] Field of Search ..... 12/146 D; 36/77 R, 72 R, 36/7.2

[56] References Cited

U.S. PATENT DOCUMENTS

| | | | |
|---|---|---|---|
| 1,326,542 | 12/1919 | Stebor, Jr. | 36/72 R |
| 2,268,435 | 12/1941 | Zucker | 36/72 R |
| 2,723,469 | 11/1955 | Shusterman | 36/72 R |
| 3,091,871 | 6/1963 | Tronche | 36/72 R |
| 3,798,804 | 3/1974 | Funck | 36/72 R |
| 4,005,534 | 2/1977 | Crist et al. | 36/72 R |
| 4,069,599 | 1/1978 | Alegria | 36/72 R |
| 4,257,177 | 3/1981 | Unsted | 36/72 R |
| 4,412,393 | 11/1983 | Terlizzi, Jr. et al. | 36/108 |
| 4,523,346 | 6/1985 | Auberry | 12/133 R |

FOREIGN PATENT DOCUMENTS

| | | | |
|---|---|---|---|
| 18565 | 9/1901 | United Kingdom | 36/72 R |

*Primary Examiner*—Werner H. Schroeder
*Assistant Examiner*—Steven N. Meyers
*Attorney, Agent, or Firm*—Charles L. Lovercheck; Wayne L. Lovercheck; Dale R. Lovercheck

[57] ABSTRACT

A shoe protector made up of a toe protector adapted to slip over the toe of a shoe and half sole attached to the toe protector. An instep strap is attached to the half sole to support the half sole on a shoe and a heel strap has its ends attached to the instep strap for holding the instep strap in position. The heel strap has an adjustable buckle. A metatarsal protector for use with the shoe protector in likewise diclosed.

2 Claims, 6 Drawing Figures

REMOVABLE SHOE PROTECTOR

REFERENCE TO PRIOR APPLICATION

This application is a continuation-in-part of application Ser. No. 323,183, filed Nov. 20, 1981.

STATEMENT OF THE INVENTION

There is a need for a toe protector in industry, among consumers and other places where heavy objects are likely to fall onto the feet of a person causing injury. These toe protectors are usually heavy and cumbersome, inconvenient to put on and to take off and unsightly.

The ordinary consumer and homeowner, or gardner, is exposed to many hazards such as power lawn mowers which cause the loss of toes or damage to the feet. The feet of gardners, farmers and ranchers are frequently exposed to hazards. The protector disclosed herein fills this long felt need and provides a shoe protector that meets OSHA standards.

BACKGROUND OF INVENTION

Warehouses, manufacturing establishments, and other business establishments have various objects that may fall on and injure the toes of personnel. Safety shoes are the common solution to this problem. Safety shoes require that the wearer remove his street shoes to don the safety shoes. Various efforts have been made to provide a removable foot protector that can be worn with regular street shoes but these protectors were uncomfortable to wear and inconvenient to put on.

REFERENCE TO PRIOR ART

The following prior art is known to Applicant which does not show a protector such as Applicant discloses herein.

U.S. Pat. No. 2,723,469 to Shusterman, November 1955 and Great Britain Pat. No. 18,565 to John, September 1901.

OBJECTS OF THE INVENTION

It is an object of the invention is to provide an improved shoe protector.

Another object of the invention is to provide an improved shoe protector that is simple in construction, economical to manufacture, and simple and efficient to use.

Another object is to provide a shoe protector that is easily attached to a shoe and easily removed from the shoe.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
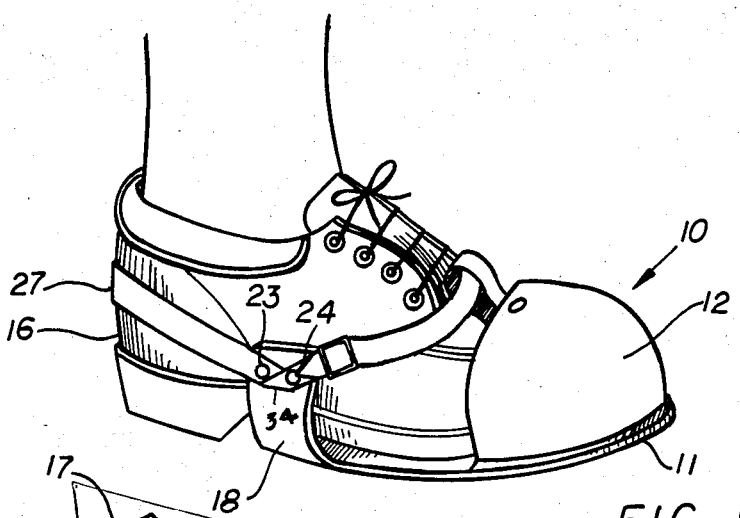
FIG. 1 is a isometric view of a shoe protector according to the invention on a shoe for the right foot of a wearer.
Figure 2:
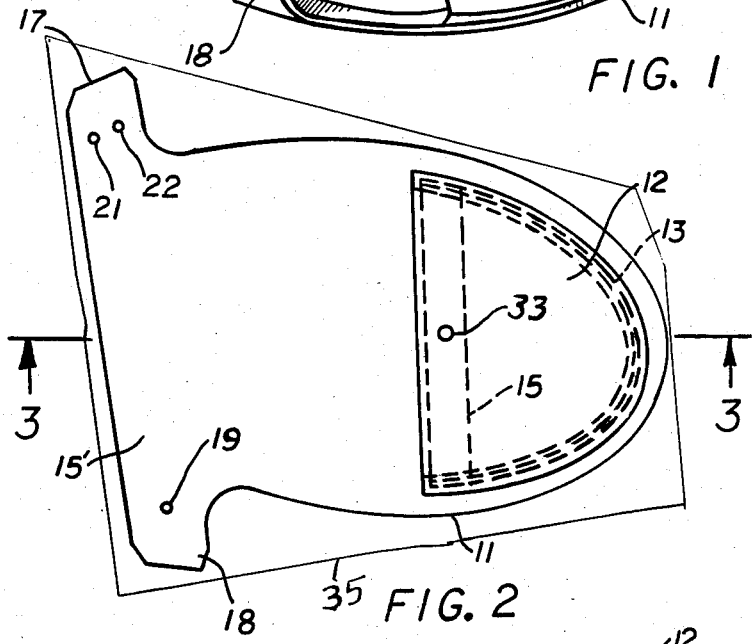
FIG. 2 is a top view of the shoe protector according to the invention shown in FIG. 1 for the left foot of a wearer with the support straps removed.
Figure 3:
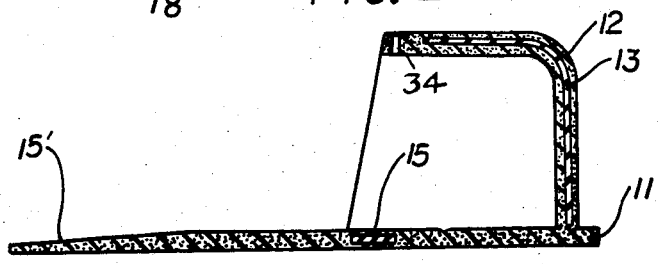
FIG. 3 is a cross sectional view taken on line 3—3 of FIG. 2.
Figure 4:
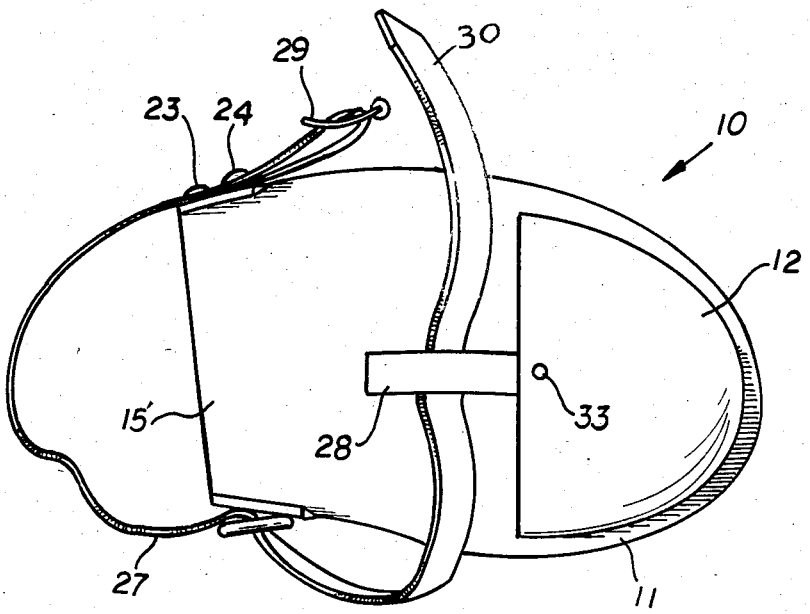
FIG. 4 is a top view of the shoe protector with ankle straps in place according to the invention for the left foot of a wearer.
Figure 5:
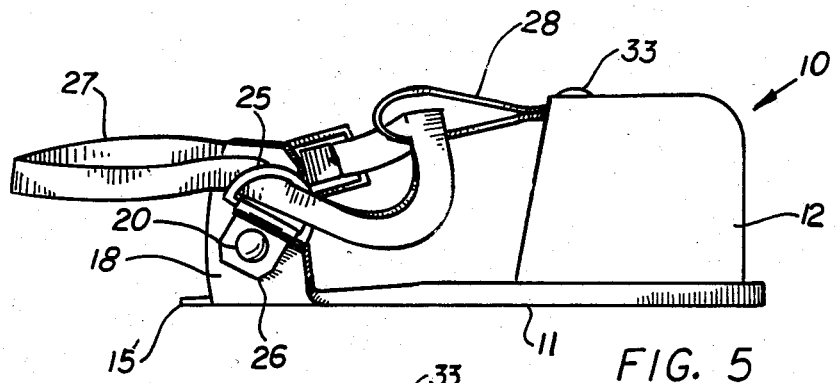
FIG. 5 is side view of the shoe protector with ankle straps in place as shown in FIG. 4.
Figure 6:
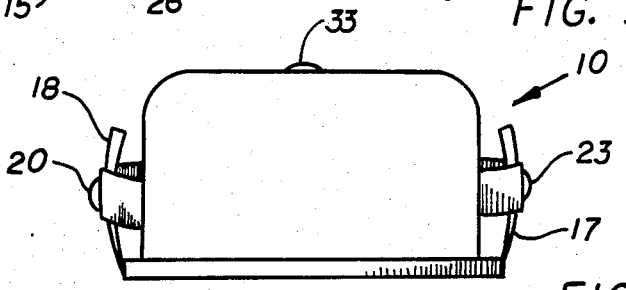
FIG. 6 is a front view of the shoe protector.

Now with more specific reference to the drawings, the shoe protector is indicated generally at 10. The shoe protector has a half sole 11 and a cap 12 integrally molded together with the metal cap element 13 molded in it. The molding is done in a typical injection mold of a type familiar to those skilled in the art. A reinforcing bar 15 can also be inserted in the mold optionally but is not required. The bar 15 helps maintain the bottom of the half sole flat. The half sole tapers rearwardly at 15' and forms a generally wedge shaped part at the instep of the shoe 16. The half sole 11 has the wings 17 and 18 integrally molded to it. Wing 18 has a single hole 19 which receives rivet 20. Tab 26 passes through ring 25 and is held by rivet 20. One end of strap 27 passes through buckle 29. Rivets 23 and 24 pass through holes 21 and 22 and through strap 27. Strap 27 is twisted and folded at 34 and rivet 24 goes through one side of the twist at 34. Strap 27 may be made of woven nylon with no holes and passes around the back of the heel of the shoe 16 through ring 25 and through loop 28 and buckle 29. End 30 is received in buckle 29 to hold strap 27. Tab 28 is held in place by rivet 33 which extends through hole 34 in cap 12.

The die 35 in which the shoe protector is molded will have a cavity complementary in shape to the shape of the shoe protector 10 and metal cap 13 and bar 15 are inserted in the mold.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A shoe protector comprising, a relatively flat half sole having a first part and a second part, a toe protector made of thermoplastic material integrally molded to said first part of said half sole and adapted to extend rearwardly thereon, said toe protector comprising a metallic toe protector member, of substantially the same shape and size as said toe protector, imbedded in said thermoplastic material of said toe protector, said toe protector being adapted to receive the toe of a shoe, having a toe, a sole and a heel, with said half sole terminating adjacent said heel of said shoe, a metallic bar imbedded in said half sole below said second part of said toe protector for reinforcing said half sole, said part of said half sole adjacent said heel being relatively thin and extending outwardly and terminating in outwardly extending first and second wings integrally attached to said half sole, said wings forming a continuation of the sides of said half sole and terminating in an edge approximately equal in length to the height of said toe of said toe protector, a strap having a first end, a second end and an intermediate part between said first end and said second end, said first end of said strap being fixed to the upper end of said first wing and said intermediate part extending rearwardly around the rear part of said shoe, said second end of said strap attached to said second wing then extending forwardly through a loop attached to said toe protector and then rearwardly to said first wing, a buckle on said first end of said strap, said second end of said strap being received in said buckle whereby said toe protector is supported on said shoe.

2. The shoe protector recited in claim 1 wherein said second end of said strap is fixed to said second wing by means of one fastener and said first end of said strap is fixed to said first wing by means of two fasteners with said strap twisted between said two fasteners.

* * * * *